US011976436B2

(12) United States Patent
Kovar

(10) Patent No.: US 11,976,436 B2
(45) Date of Patent: May 7, 2024

(54) EXCAVATOR THUMB WITH STRUCTURAL SUPPORT

(71) Applicant: Caterpillar Inc., Peoria, IL (US)

(72) Inventor: Aaron D. Kovar, Topeka, KS (US)

(73) Assignee: Caterpillar Inc., Peoria, IL (US)

( * ) Notice: Subject to any disclaimer, the term of this patent is extended or adjusted under 35 U.S.C. 154(b) by 323 days.

(21) Appl. No.: 17/412,783

(22) Filed: Aug. 26, 2021

(65) Prior Publication Data

US 2023/0067610 A1 Mar. 2, 2023

(51) Int. Cl.
*E02F 3/40* (2006.01)

(52) U.S. Cl.
CPC ..... *E02F 3/404* (2013.01)

(58) Field of Classification Search
CPC ..... E02F 3/404; E02F 3/4135
See application file for complete search history.

(56) References Cited

U.S. PATENT DOCUMENTS 5,813,822 A * 9/1998 Pisco ..... E02F 3/4135 414/723
7,533,481 B2 5/2009 McCoy
7,617,619 B2 * 11/2009 Cox ..... E02F 3/404 37/406
7,818,901 B2 * 10/2010 Zeno ..... E02F 3/404 37/406
8,695,239 B2 * 4/2014 Seda ..... E02F 3/96 37/406
9,015,968 B2 * 4/2015 Kovar ..... E02F 3/404 37/406
9,194,098 B2 * 11/2015 Shea ..... E02F 3/404
9,194,099 B2 * 11/2015 Shea ..... E02F 3/404
9,303,383 B2 * 4/2016 Tan ..... E02F 3/3411
9,404,236 B2 8/2016 Toraason et al.
9,476,179 B2 * 10/2016 Seljestad ..... E02F 3/413
D983,235 S * 4/2023 Kovar ..... D15/32
2003/0012597 A1 * 1/2003 Miller ..... E02F 3/404 403/322.2
2010/0058622 A1 * 3/2010 Calvert ..... E02F 3/962 37/405

(Continued)

FOREIGN PATENT DOCUMENTS

JP 5-709791 B2 10/2013
JP 2015-078509 A 4/2015

OTHER PUBLICATIONS

Written Opinion and International Search Report for Int'l. Patent Appln. No. PCT/US2022/039779, dated Dec. 2, 2022 (8 pgs).

*Primary Examiner* — Jessica H Lutz

(57) ABSTRACT

One embodiment of a thumb for an implement of a machine has first and second side plates each having a pivot end for pivotally connecting to a linkage of the machine and an engagement end for engaging with a load. The thumb also has a belly plate extending across a width of the thumb between the first and second side plates and extending along a length of the thumb from the pivot end toward the engagement end. Additionally, the thumb has a thumb support structure disposed closer to the engagement end than to the pivot end. The thumb support structure has a first support plate extending widthwise between the first and second side plates and a second support plate extending widthwise between the first and second side plates and further extending between the first support plate and the belly plate.

20 Claims, 5 Drawing Sheets

(56) References Cited

U.S. PATENT DOCUMENTS

| | | | | |
|---|---|---|---|---|
| 2013/0115038 | A1* | 5/2013 | Bargellini | E02F 3/413<br>37/406 |
| 2014/0007467 | A1 | 1/2014 | Kovar et al. | |
| 2014/0102243 | A1* | 4/2014 | Shea | E02F 3/404<br>74/527 |
| 2014/0230587 | A1* | 8/2014 | Shea | E02F 9/2271<br>74/103 |

* cited by examiner

EXCAVATOR THUMB WITH STRUCTURAL SUPPORT

TECHNICAL FIELD

This disclosure relates generally to excavator machines having articulating ground-engaging implements with counteracting thumbs. In particular, this disclosure relates to structural support in the thumb for withstanding forces and stresses in the thumb during operation of the excavator.

BACKGROUND

Mining and construction machines such as backhoe loaders and excavators employ various implements—such as buckets, rams, forks, grapples, thumbs, and the like, to perform different operations. For example, a machine may use a bucket and counteracting thumb to grasp, hold, and lift work material such as boulders, pipes, trees, structural components, and the like.

In some cases, the work material may have an irregular shape causing uneven weight distributions and/or forces across the bucket and thumb, which may concentrate stresses in certain areas and/or on certain components. To alleviate and redistribute such stresses, excavator thumbs may have components providing structural support and integrity to the thumb. For example, structural supports connecting the teeth of the thumb to the side plates and main body of the thumb help reinforce the thumb and transfer loads from one side of the thumb to the other.

U.S. Pat. No. 7,818,901 to Zeno et al. ("the '901 patent") discloses an excavator thumb with a circular tube as a support structure connecting the teeth of the thumb to the side plates. According to the '901 patent, the tube provides better load transfer between the side plates under offset load conditions than a flat plate.

While the solution of the '901 patent may increase the ability of the excavator thumb to handle irregular loads, the '901 patent thumb may lack structural support under other circumstances. This disclosure is directed to one or more improvements in the existing excavator thumb technology.

SUMMARY

One aspect of the disclosure relates to a thumb for an implement of a machine. The thumb may include first and second side plates having a pivot end for pivotally connecting to a linkage of the machine and an engagement end for engaging with a load. The thumb may further include a belly plate extending across a width of the thumb between the first and second side plates and extending along a length of the thumb from the pivot end toward the engagement end. The thumb may further include a thumb support structure disposed closer to the engagement end than to the pivot end. The thumb support structure may include a first support plate extending widthwise between the first and second side plates and a second support plate extending widthwise between the first and second side plates and further extending between the first support plate and the belly plate.

Another aspect of the disclosure relates to a thumb for an implement of a machine. The thumb may include first and second side plates having a pivot end for pivotally connecting to a linkage of the machine and an engagement end for engaging with a load. The thumb may further include a belly plate extending across a width of the thumb between the first and second side plates and extending along a length of the thumb from the pivot end toward the engagement end. The thumb may include a thumb support structure disposed closer to the engagement end than to the pivot end. The thumb support structure may include a first support plate extending widthwise between the first and second side plates, the first support plate being concave toward the engagement end. The thumb support structure may further include a second support plate adjacent the first support plate on an engagement end side of the first support plate, the second support plate extending widthwise between the first and second side plates and being concave toward the first support plate. Additionally, a third support plate may extend widthwise between the first and second side plates and further extend between the first support plate and the belly plate.

Yet another aspect relates to a machine including a linkage and an implement pivotally connected to the linkage and having a thumb. The thumb may include first and second side plates having a pivot end for pivotally connecting to the linkage and an engagement end for engaging with a load. The thumb may include a belly plate extending across a width of the thumb between the first and second side plates and extending along a length of the thumb from the pivot end toward the engagement end. The thumb may further include a thumb support structure disposed closer to the engagement end than to the pivot end. The thumb support structure may include a first support plate extending widthwise between the first and second side plates, the first support plate being convex toward the engagement end. The thumb support structure may further include a second support plate adjacent the first support plate on an engagement end side of the first support plate, the second support plate extending widthwise between the first and second side plates and being concave toward the first support plate. Additionally, a third support plate may extend widthwise between the first and second side plates and further extend between the first support plate and the belly plate.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
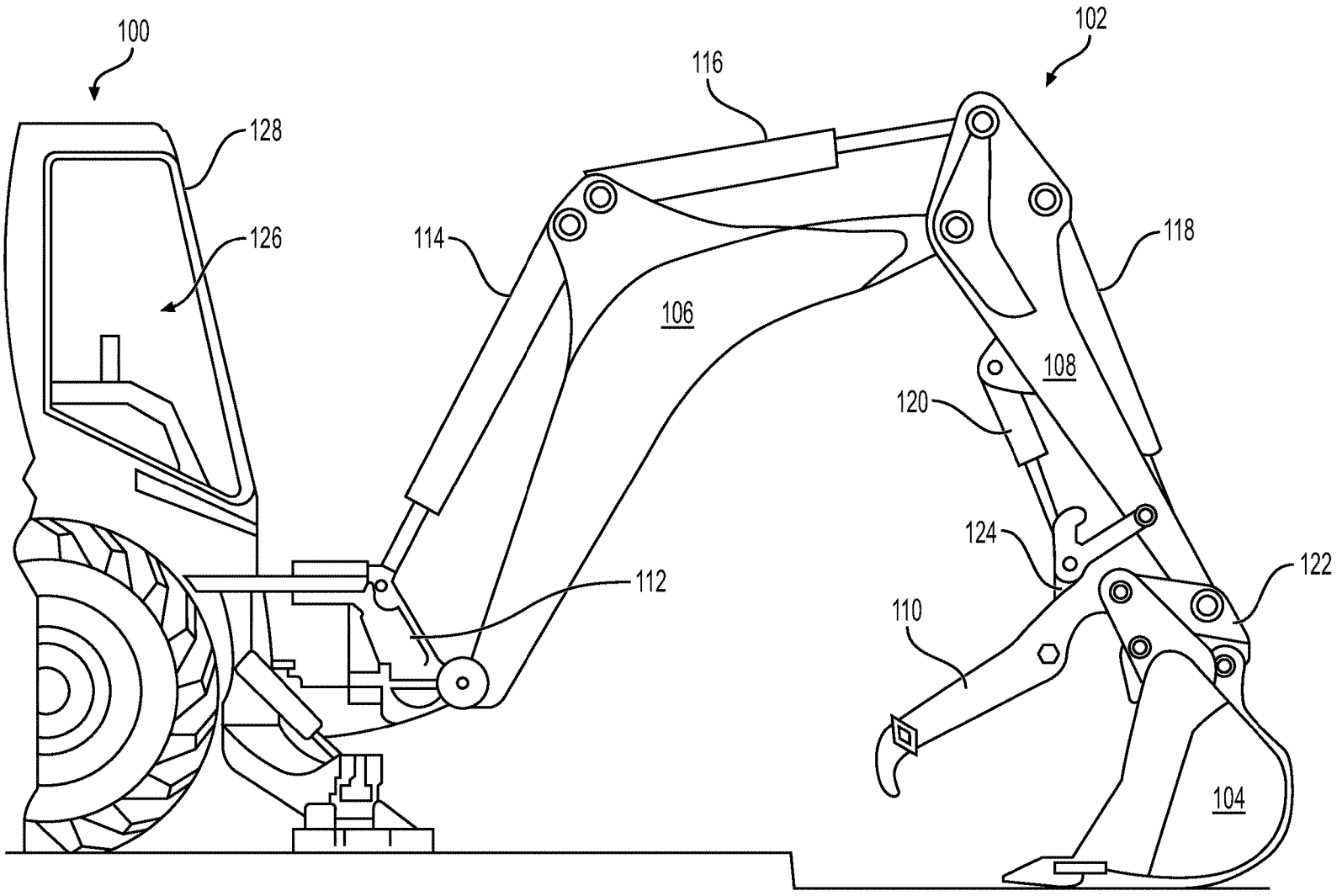
FIG. 1 is a side elevation view of a machine having an articulating ground-engaging implement with a counteracting thumb in accordance with the present disclosure.

FIG. 1 depicts a machine 100 to perform different operations on work material at a work site. Machine 100 may include a linkage assembly 102 for manipulating an implement, such as bucket 104, to perform the operations on the work material. While machine 100 is depicted as a backhoe loader, machine 100 may alternatively be an excavator or any other type of machine having a linkage for performing operations with an implement on work material.

As shown, linkage assembly 102 includes a boom 106, a stick 108 pivotally coupled to boom 106, bucket 104 pivotally coupled to stick 108, and a counteracting thumb 110 also pivotally coupled to stick 108. Linkage assembly 102 may pivotally connect to a boom support bracket 112 of machine 100. Additionally, a boom lift actuator 114 is operably coupled between boom 106 and machine 100 to rotate boom 106 with respect to machine 100, raising and lowering linkage assembly 102.

Similarly, a stick extension actuator 116 is operably coupled between boom 106 and stick 108 to rotate stick 108 with respect to boom 106. A bucket articulation actuator 118 and a thumb actuator 120 are operably coupled between stick 108 and bucket 104 and between stick 108 and thumb 110, respectively, by respective linkages 122, 124, and rotate bucket 104 and thumb 110, respectively, with respect to stick 108. Actuators 114, 116, 118, 120 may be hydraulic cylinders each having a head end and a rod end. Hydraulic fluid directed to the head ends may extend actuators 114, 116, 118, 120, while hydraulic fluid directed to the rod ends may retract actuators 114, 116, 118, 120. An operator may use a plurality of levers 126, or other operator interface devices, within an operator cab 128 of machine 100 to command actuators 114, 116, 118, 120 through a control device (not shown).

During operation of machine 100, bucket 104 and thumb 110 in combination may be used to pick up loads of work material, including odd- or irregular-sized loads. For example, the operator of machine 100 may pick up a boulder by scooping the boulder into bucket 104 and manipulating levers 126 to actuate thumb actuator 120 to close thumb 110 over bucket 104 and engage and hold the boulder until the boulder is dumped. As another example, elongated work material, such as tree trunks and piping may be picked up by enclosing the material with bucket 104 and thumb 110, closing bucket 104 and thumb 110 around the work material, and lifting the material off the ground. Manipulating these types of materials can impose unbalanced loads on bucket 104 and thumb 110 such that more force is exerted on some areas of bucket 104 and thumb 110 than others, creating concentrated stresses that, over time, may damage bucket 104 and/or thumb 110.

Figure 2:
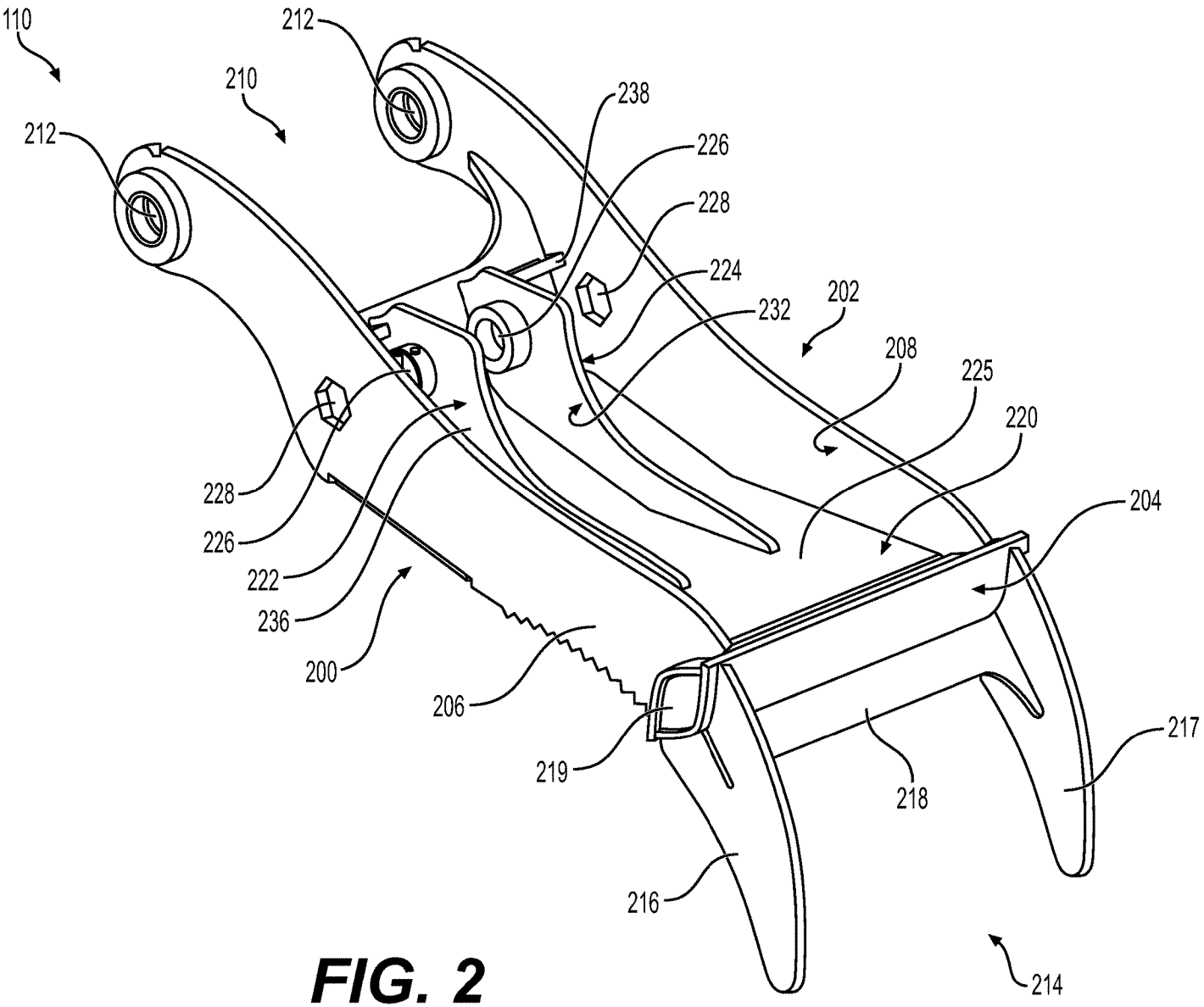
FIG. 2 is a front right perspective view of the counteracting thumb of the machine of FIG. 1.

FIG. 2 illustrates thumb 110 in accordance with the present disclosure, configured to distribute such unbalanced or asymmetrical loads throughout thumb 110 and thereby reduce or eliminate such concentrated stresses. Additionally, consistent with the disclosed embodiments, thumb 110 may have a thumb support structure 204 configured to provide additional support against rotation or deformation of the tines and/or teeth attached to thumb 100 when engaging, holding, manipulating, or otherwise handling material loads, as discussed below.

Figure 3:
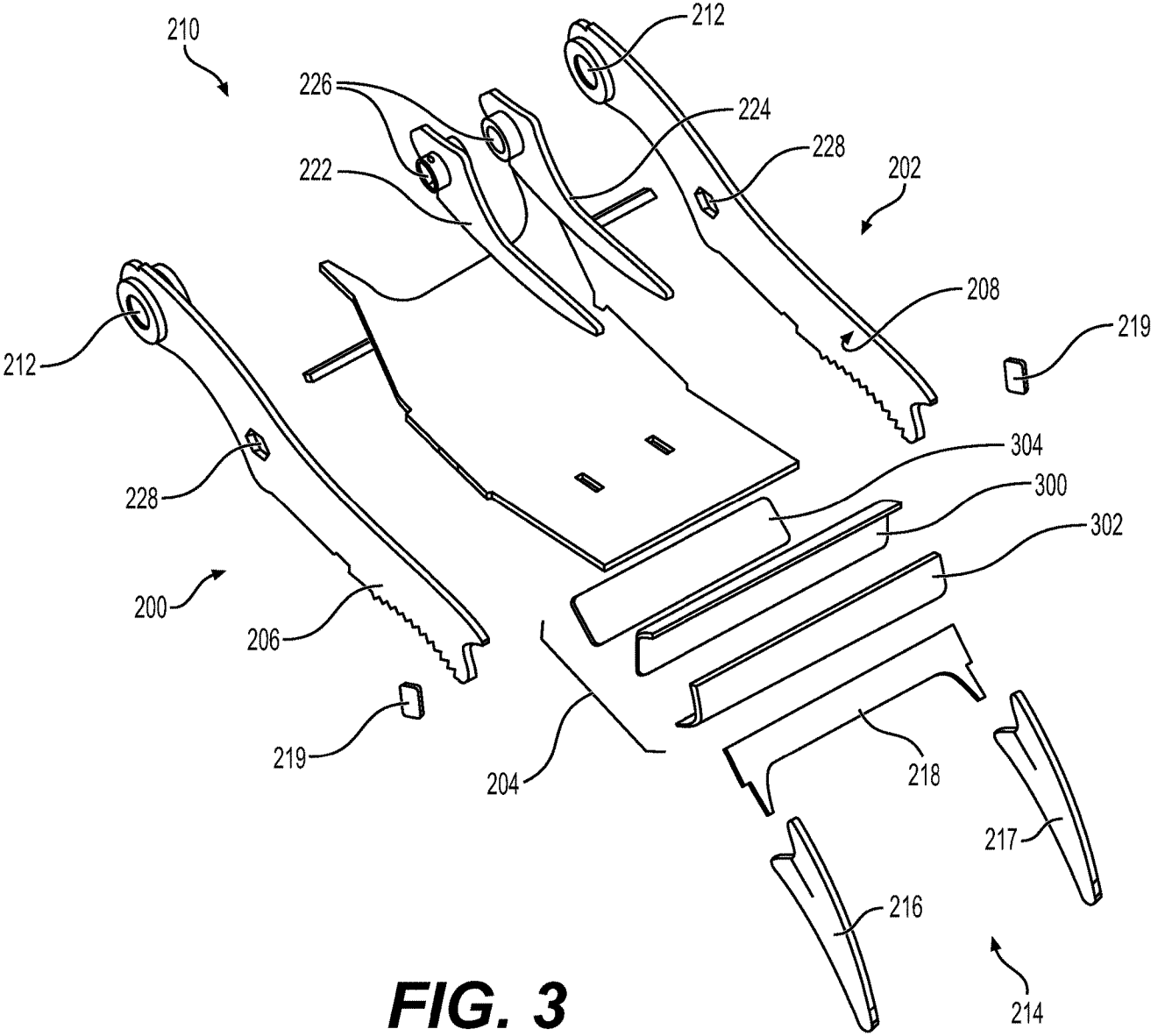
FIG. 3 is an exploded view of the counteracting thumb of the machine of FIG. 1.

FIG. 3 provides an exploded view of the components of thumb 110. As shown in FIGS. 2 and 3, thumb 110 may include a first side plate 200 and a second side plate 202. An attachment having a plurality of teeth (not shown) may be connected to thumb 110 by mounting it to thumb support structure 204.

Each of first and second side plates 200, 202 may include an outer surface 206 and an inner surface 208 facing inner surface 208 of the opposite side plate 200, 202. At a pivot end 210 of thumb 110, first and second side plates 200, 202 may have reinforced openings 212 for pivotally connecting first and second side plates 200, 202 to stick 108 via a stick pivot pin (not shown). The stick pivot pin may be shared with bucket 104 or with a coupler (not shown) connecting bucket 104 to stick 108. At a material engagement end 214 of thumb 110, first and second side plates 200, 202 may transition into respective tines 216, 217 for engaging the work material alongside the teeth, if attached to thumb 110. The transition may be integral or tines 216, 217 may be separate structures attached, directly or indirectly, to the respective first and second side plates 200, 202.

At material engagement end 214, thumb 110 may include a gusset plate 218 extending between first and second side plates 200, 202 and configured to support and unitize tines 216, 217 and the thumb teeth (if attached), providing additional strength to withstand lateral forces acting on tines 216, 217 and/or the teeth in a direction generally parallel to an axis defined by openings 212. As shown in FIG. 2, gusset plate 218 may be located at material-engagement end 214 of thumb support structure 204 and extend between tines 216, 217—across the width of thumb support structure 204 from inner surface 208 of one side plate 200 to inner surface 208 of the other side plate 202. Additionally, thumb support structure 204 may have end caps 219 covering openings in first and second side plates 200, 202 defined by thumb support structure 204.

Thumb 110 may include a belly plate 220 in the interior of thumb 110. Belly plate 220 may extend across the width of thumb 110 between first and second side plates 200, 202 and may further extend along a length of thumb 110 from at or proximate to pivot end 210, in the direction of material engagement end 214, to thumb support structure 204.

Belly plate 220 may provide an attachment surface for components of thumb 110 to which linkage 124 connects. For example, as shown in FIGS. 2 and 3, belly plate 220 may include a pair of spaced-apart yoke plates 222, 224. Yoke plates 222, 224 may be planar and lie in planes substantially perpendicular to all or part of an exterior surface 225 of belly plate 220 and substantially parallel to first and second side plates 200, 202. Yoke plates 222, 224 may have yoke plate openings 226 through which a thumb actuator pivot pin (not shown) may extend between yoke plates 222, 224 to pivotally connect thumb 110 to thumb actuator 120. Yoke plate openings 226 may align with corresponding side plate openings 228 for installing the thumb actuator pivot pin on thumb 110. Specifically, the thumb actuator pivot pin may be inserted through one of side plate openings 228 and then through yoke plate openings 226 to connect yoke plates 222, 224 with thumb actuator 120.

Figure 4:
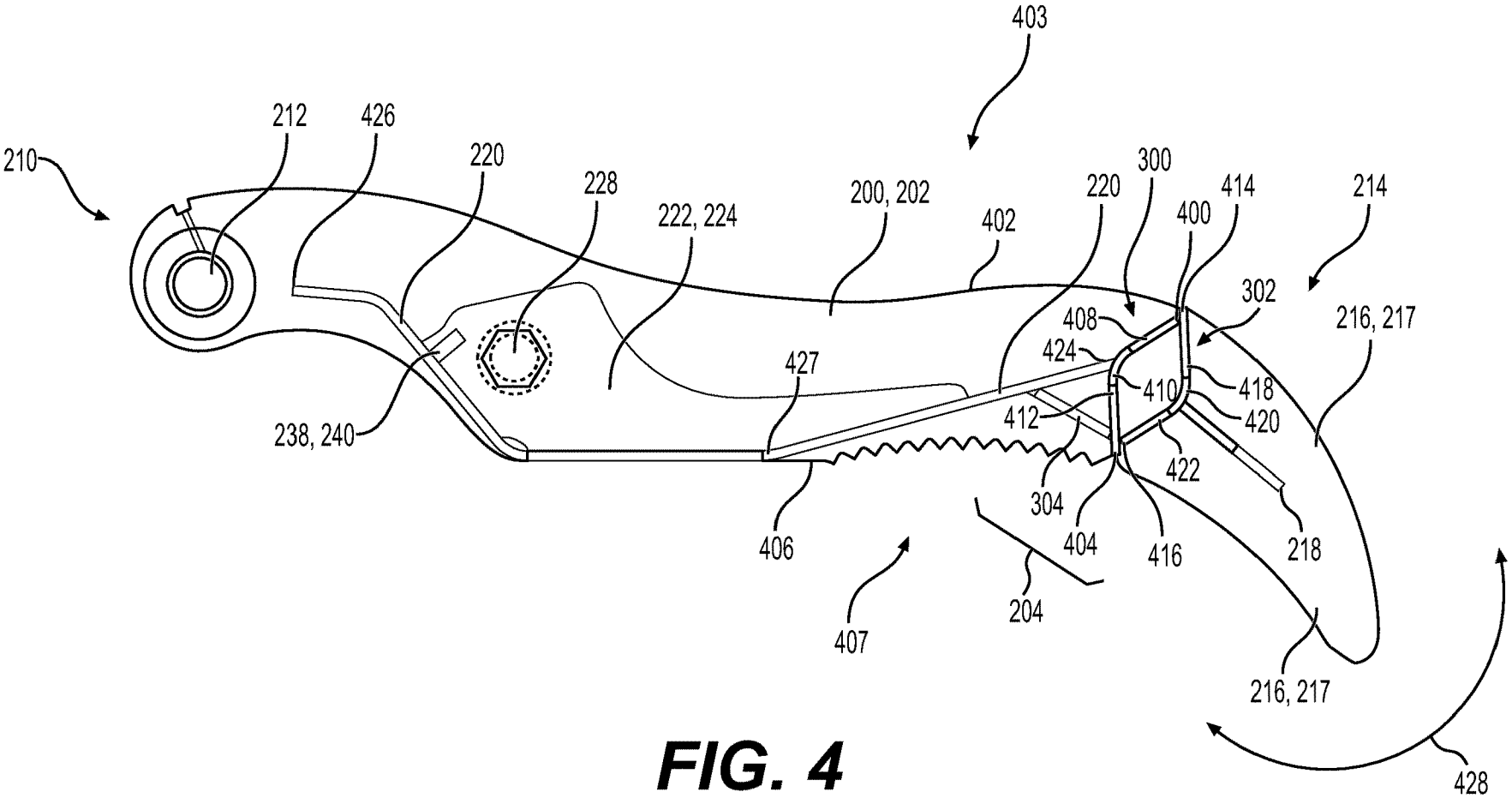
FIG. 4 is a side cross-sectional view of the counteracting thumb of FIG. 2.

As shown in the exploded view of thumb 110 in FIG. 3, thumb support structure 204 may include a first support plate 300, a second support plate 302 adjacent first support plate 300 on material engagement end 214 side of first support plate 300, and a third support plate 304. In FIG. 4, a side cross-sectional view of thumb 110 shows thumb support structure 204 in more detail. First and second support plates 300, 302 may extend laterally across the width of thumb 110, from side plate 200 to side plate 202. First support plate 300 may have an exterior edge 400 terminating proximate exterior edges 402 of first and second side plates 200, 202—on an exterior side 403 of thumb 110 facing away from bucket 104. Additionally, first support plate 300 may have an interior edge 404 terminating at interior edges 406 of first and second side plates 200, 202—on an interior side 407 of thumb 110 facing bucket 104.

First support plate 300 may comprise a first flat portion 408 having exterior edge 400. First flat portion 408 may be connected, by an intermediate curved portion 410 of first support plate 300, to a second flat portion 412 of first support plate 300 that has interior edge 404. Additionally, curved portion 410, and first support plate 300 as a whole, may be concave toward second support plate 302 and toward material engagement end 214 of thumb 110. On the other hand, curved portion 410, and first support plate 300 as a whole, may be convex toward pivot end 210 of thumb 110. First and second flat portions 408, 412 may be welded to curved portion 410 to form first support plate 300, or first support plate 300 may be an integral component.

Second support plate 302 may have an exterior edge 414 terminating at exterior edges 402 of first and second side plates 200, 202 and an interior edge 416 terminating proximate interior edges 406 of first and second side plates 200, 202. Second support plate 302 may comprise a first flat portion 418 having exterior edge 414. First flat portion 418 may be connected, by an intermediate curved portion 420 of second support plate 302, to a second flat portion 422 of second support plate 302 that has interior edge 416. Additionally, curved portion 420, and second support plate 302 as a whole, may be concave toward first support plate 300 and toward pivot end 210 of thumb 110. On the other hand, curved portion 420, and second support plate 302 as a whole, may be convex toward material engagement end 214 of thumb 110. As with first support plate 300, first and second flat portions 418, 422 of second support plate 302 may be welded to curved portion 420 to form second support plate 302, or second support plate 302 may be an integral component.

As shown in FIG. 4, first and second support plates 300, 302 may overlap one another such that exterior edge 414 of second support plate 302 extends beyond exterior edge 400 of first support plate 300 at exterior side 403 of thumb 110 and such that interior edge 404 of first support plate 300 extends beyond interior edge 416 of second support plate 302 at interior side 407 of thumb 110. First edge 400 of first support plate 300 may be connected by welding to first flat portion 418 of second support plate 302, proximate exterior edge 414 of second support plate 302. Likewise, interior edge 416 of second support plate 302 may be connected by welding to second flat portion 412 of first support plate 300, proximate interior edge 404 of first support plate 300.

Continuing with FIG. 4, gusset plate 218 may connect by welding to curved portion 420 of second support plate 302 on the convex side of second support plate 302—the side of second support plate 302 facing material engagement end 214 of thumb 110. And gusset plate 218 may extend from curved portion 420 in the direction of tines 216, 217—i.e., in the direction of material engagement end 214. Belly plate 220 may connect at a first edge 424 by welding to curved portion 410 of first support plate 302 on the convex side of first support plate 300—the side of first support plate 300 facing pivot end 210 of thumb 110—and may extend from curved portion 420 in the general direction toward pivot end 210 and terminate at a second edge 426 toward pivot end 210 of thumb 110. As shown in FIG. 4, at least a portion of belly plate 220 may intersect, or become flush with, interior edges 406 of first and second side plates 200, 202 at an intersection point 427 about midway between pivot end 210 and material engagement end 214.

In operation, first and second support plates 300, 302 may support tines 216, 217 and any attached teeth when engaging or holding material loads. Specifically, when tines 216, 217 and/or teeth attached to thumb 110 engage, hold, manipulate, or otherwise interact with material loads, the forces applied may generate a torque 428 that tends to bend tines 216, 217 and/or the teeth in the directions shown by the arrow in FIG. 4. The structure defined by first and second support plates 300, 302, however, may provide a substantial attachment interface for tines 216, 217 and/or the teeth that resists this bending of tines 216, 217. Consistent with the disclosure, and as further discussed below, third support plate 304 (e.g., a second gusset plate) may provide further structural support to first and second support plates 300, 302 to resist the bending. As shown in FIG. 4, third support plate 304 may extend between first support plate 300 and belly plate 220 on interior side 407 of thumb 110.

Figure 5:
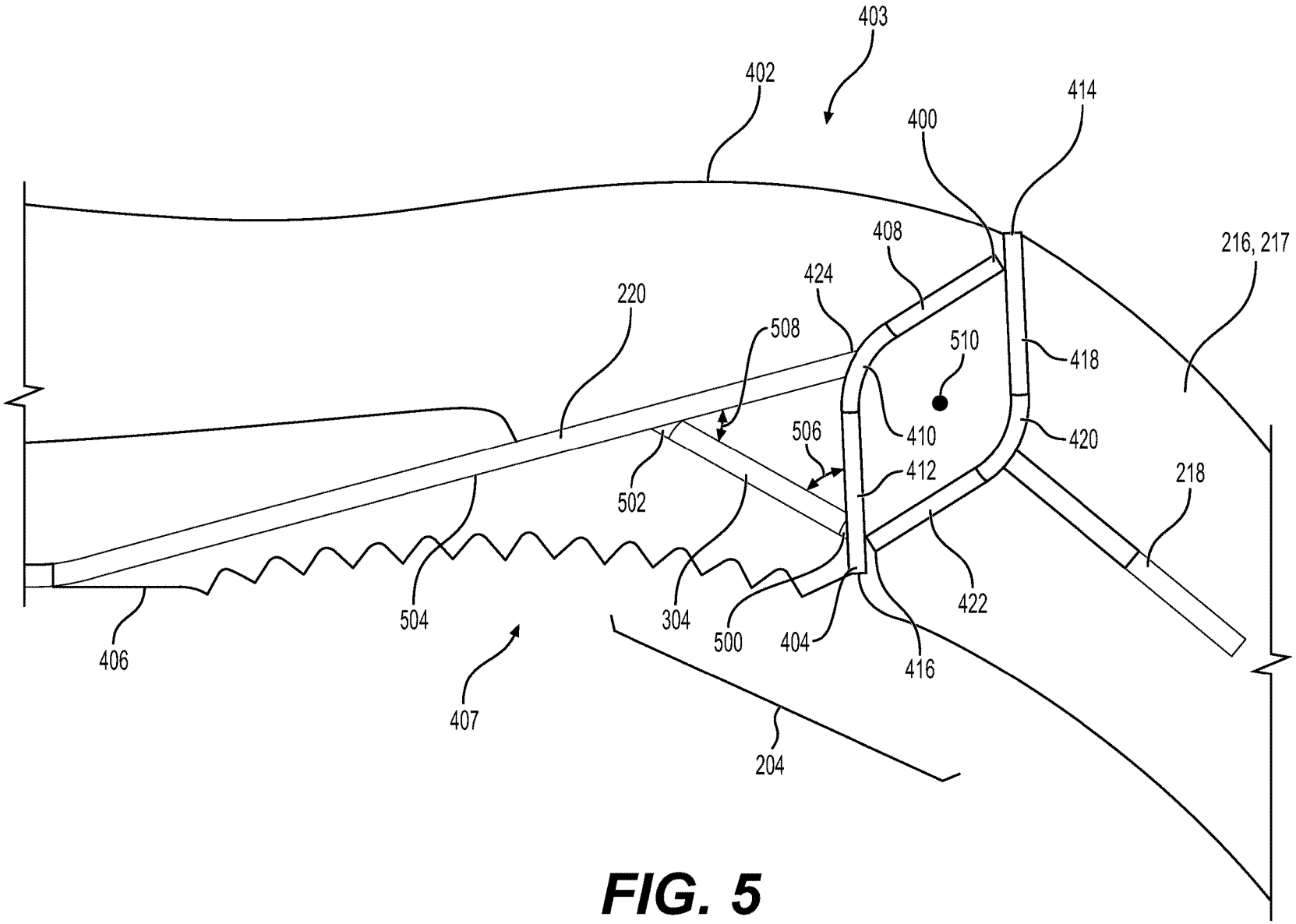
FIG. 5 is an enlarged side cross-sectional view of a portion of the counteracting thumb of FIG. 2, including a thumb support structure.

FIG. 5 provides a zoomed-in view of thumb support structure 204. As shown in FIG. 5, a first end 500 of third support plate 304 may connect by welding to first support plate 300 proximate interior edge 404 of first support plate 300. Specifically, first end 500 of third support plate 304 may connect to second flat portion 412 of first support plate 300, proximate interior edge 404. A second end 502 of third support plate 304 may connect by welding to an interior surface 504 of belly plate 220—the surface of belly plate 220 on interior side 407 of thumb 110 facing bucket 104. In one embodiment, third support plate 304 may connect to belly plate 220 at a point closer to first edge 424 of belly plate 220 than to intersection point 427 (see also FIG. 4). For example, second end 502 of third support plate 304 may intersect belly plate 220 at a point about 25% of the distance between first edge 424 of belly plate 220 and intersection point 427.

Additionally, in some embodiments, third support plate 304 may intersect second flat portion 412 of first support plate 300 at a first angle 506. First angle 506 may be an acute angle, such as about 40-80 degrees. In one embodiment, first angle 506 may be about 60 degrees. As shown in FIG. 5, third support plate 304 may intersect interior surface 504 of belly plate 220 at a second angle 508. Second angle 508 may also be an acute angle, such as about 30-70 degrees. In one embodiment, second angle 508 may be smaller than first angle 506. For example, first angle 506 may be about 60 degrees and second angle 508 may be about 50 degrees.

In some embodiments, instead of first and second support plates 300, 302, a single support component may be used. For example, a single support plate may by used in place of first and second support plates 300, 302, and third support plate 304 may extend between the single support plate, at or proximate interior edge 406, to belly plate 220 as described above. Alternatively, a tube having a circular, square, rectangular, oval, or other shape cross-section may be used instead of first and second support plates 300, 302. In this example, third support plate 304 may extend from the tube, at or proximate interior edge 406, to belly plate 220 as described above.

It is noted that the prefixes "first," "second," and "third" for support plates 300, 302, 304 are merely intended to identify and differentiate between the three support plates 300, 302, 304 in their respective contexts in the specification and/or claims. The precise meaning of which support plate 300, 302, 304 the prefix "first," "second," or "third" identifies can be determined from its respective context in the specification or claims.

INDUSTRIAL APPLICABILITY

This disclosure applies to any machine, such as an excavator or a backhoe, having an implement with an opposing thumb. The disclosed embodiments may improve the structural support of the thumb, allowing the thumb to better handle material loads and withstand the forces generated when interacting with them, including forces generally across the width of the thumb as well as forces generally perpendicular to the thumb tending to bend the tines or teeth of the thumb.

In particular, the configuration and arrangement of third support plate 304 provide further structural support to first and second support plates 300, 302 during operation of machine 100. For example, when thumb 110 engages, holds, or manipulates material loads, torque 428 tends to bend tines 216, 217 and/or the teeth. The bending tends to rotate first and second support plates 300, 302—to which tines 216, 217 and the teeth are attached—about an axis 510. This rotation, in turn, may apply tension and/or compression forces to third support plate 304 because third support plate 304 is attached to first support plate 300 at second flat portion 412 near exterior edge 414.

Anchored against belly plate 220, however, third support plate 304 may produce opposing forces that counteract the tension and/or compression forces applied to third support plate 304 by first and second support plates 300, 302, thereby further supporting and preventing rotation of first and second support plates 300, 302. And, prevented from rotation, first and second support plates 300, 302 may in turn prevent tines 216, 217 and/or attached teeth from bending despite torque 428 applied by the operation of thumb 110 against the material load.

Accordingly, in comparison to conventional thumb support structures, the disclosed thumb support structure 204 may not only provide support to thumb 110 against forces in the general direction across the width of thumb 110. But thumb support structure 204 may also provide additional support to first and second support plates 300, 302 to resist rotation and/or bending of tines 216, 217 and/or teeth attached to thumb 110 caused by forces generally perpendicular to thumb 110. This may help alleviate concentrated stresses within thumb 110, thereby improving the performance, avoiding wear and damage, and extending the service life of thumb 110. Additionally, thumb support structure 204 may increase torsional stiffness (i.e., sideward twisting stiffness), such as when a load is heavier on the one side of thumb 110 than the other, causing torsion generally about an axis running from pivot end 210 to material engagement end 214.

The disclose thumb support structure 204 may provide other benefits as well. For example, the added structural support offered by thumb support structure 204 may allow thumb 110 to be formed from less material (e.g., steel) than conventional thumbs, reducing weight and cost without sacrificing the structural integrity of thumb 110. For example, the thicknesses of first and second side plates 200, 202, belly plate 220, and/or other components of thumb 110 may be reduced, requiring less steel to produce thumb 110. Alone or in combination with other reductions, thumb support structure 204 may allow for about a 20-25% reduction in the weight of the thumb 100 as compared to a conventional thumb lacking thumb support structure 204 but incorporating thicker and/or heavier duty materials to achieve comparable structural integrity.

The reduction in weight of thumb 110, in turn, may allow for cascading cost improvements and/or savings throughout machine 100. For example, with a lighter thumb 110, the existing linkage assembly 102, actuators 114, 116, 118, 120, and/or the hydraulic system on a given machine 110 might be considered "overbuilt" relative to thumb 110 from an engineering perspective. Accordingly, a designer or engineer may opt to similarly scale down the size, power, performance, materials, etc. of such additional components in proportion to the reduction in weight of thumb 110, further reducing the weight and cost of machine 100.

Although the foregoing description refers to use of the invention with a bucket, the invention is not limited thereto, and can be employed with any suitable machine implement.

As used herein, the term "substantially" signifies a margin of approximately +/−10% of a specified dimension or value.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A thumb for an implement of a machine, the thumb comprising:

first and second side plates each having a pivot end for pivotally connecting to a linkage of the machine and an engagement end for engaging with a load;

a belly plate extending across a width of the thumb between the first and second side plates and extending along a length of the thumb from the pivot end toward the engagement end; and a thumb support structure disposed closer to the engagement end than to the pivot end, the thumb support structure including:

a first support plate extending widthwise between the first and second side plates;

a second support plate extending widthwise between the first and second side plates and further extending between the first support plate and the belly plate; and a third support plate including: a first flat portion having an exterior edge of the third support plate, a second flat portion having an interior edge of the third support plate, and an intermediate curved portion connecting the first flat portion of the third support plate to the second flat portion of the third support plate, such that a concave surface of the first support plate faces a second concave surface of the third support plate.

2. The thumb of claim 1, wherein the first support plate includes:

an interior edge terminating substantially at interior edges of the first and second side plates on an interior side of the thumb facing the implement; and an exterior edge terminating substantially proximate exterior edges of the first and second side plates on an exterior side of the thumb facing away from the implement.

3. The thumb of claim 2, wherein the first support plate includes a first flat portion having the exterior edge of the first support plate, a second flat portion having the interior edge of the first support plate, and an intermediate curved portion connecting the first flat portion to the second flat portion of the first support plate.

4. The thumb of claim 3, wherein an edge of the belly plate connects to the intermediate curved portion of the first support plate.

5. The thumb of claim 3, wherein a first edge of the second support plate connects to the second flat portion of the first support plate proximate the interior edge of the first support plate and a second edge of the second support plate connects to an interior surface of the belly plate facing the implement.

6. The thumb of claim 5, wherein the second support plate intersects the second flat portion of the first support plate and the belly plate at acute angles.

7. The thumb of claim 3, wherein the third support plate extends widthwise between the first and second side plates, the interior edge terminates substantially proximate the interior edges of the first and second side plates, and the exterior edge terminates substantially at the exterior edges of the first and second side plates.

8. The thumb of claim 7, wherein the exterior edge of the first support plate is connected to the first flat portion of the third support plate and the interior edge of the third support plate is connected to the second flat portion of the first support plate.

9. A thumb for an implement of a machine, the thumb comprising:

first and second side plates each having a pivot end for pivotally connecting to a linkage of the machine and an engagement end for engaging with a load;

a belly plate extending across a width of the thumb between the first and second side plates and extending along a length of the thumb from the pivot end toward the engagement end; and a thumb support structure disposed closer to the engagement end than to the pivot end, the thumb support structure including:

a first support plate extending widthwise between the first and second side plates, the first support plate being concave toward the engagement end, wherein the first support plate includes a first flat portion and a second flat portion;

a second support plate adjacent the first support plate on an engagement end side of the first support plate, the second support plate extending widthwise between the first and second side plates and being concave toward the first support plate; and a third support plate extending across a width of the thumb between the first and second side plates and further extending between the first support plate and the belly plate, wherein the third support plate intersects the second flat portion of the first support plate and the belly plate at acute angles.

10. The thumb of claim 9, wherein the first support plate includes:

an interior edge terminating substantially at interior edges of the first and second side plates on an interior side of the thumb facing the implement; and an exterior edge terminating substantially proximate exterior edges of the first and second side plates on an exterior side of the thumb facing away from the implement.

11. The thumb of claim 10, wherein the first flat portion includes the exterior edge of the first support plate, the second flat portion includes the interior edge of the first support plate, and an intermediate curved portion connects the first flat portion of the first support plate to the second flat portion of the first support plate.

12. The thumb of claim 11, wherein an edge of the belly plate connects to the intermediate curved portion of the first support plate.

13. The thumb of claim 11, wherein a first edge of the third support plate connects to the second flat portion of the first support plate proximate the interior edge of the first support plate and a second edge of the third support plate connects to an interior surface of the belly plate facing the implement.

14. The thumb of claim 11, wherein the second support plate includes an interior edge terminating substantially proximate the interior edges of the first and second side plates and an exterior edge terminating substantially at the exterior edges of the first and second side plates.

15. The thumb of claim 14, wherein the second support plate further includes a first flat portion having the exterior edge of the second support plate, a second flat portion having the interior edge of the second support plate, and an intermediate curved portion connecting the first flat portion of the second support plate to the second flat portion of the second support plate.

16. The thumb of claim 15, wherein the exterior edge of the first support plate is connected to the first flat portion of the second support plate and the interior edge of the second support plate is connected to the second flat portion of the first support plate.

17. A machine, comprising:

a linkage;

an implement pivotally connected to the linkage and having a thumb, the thumb including:

first and second side plates each having a pivot end for pivotally connecting to the linkage and an engagement end for engaging with a load;

a belly plate extending across a width of the thumb between the first and second side plates and extending along a length of the thumb from the pivot end toward the engagement end; and a thumb support structure disposed closer to the engagement end than to the pivot end, the thumb support structure including:

a first support plate extending widthwise between the first and second side plates, the first support plate being convex toward the engagement end;

a second support plate adjacent the first support plate on an engagement end side of the first support plate, the second support plate extending widthwise between the first and second side plates and being concave toward the first support plate; and a third support plate extending widthwise between the first and second side plates and further extending between the first support plate and the belly plate.

18. The machine of claim 17, wherein the first support plate includes:

an interior edge terminating substantially at interior edges of the first and second side plates on an interior side of the thumb facing the implement;

an exterior edge terminating substantially proximate exterior edges of the first and second side plates on an exterior side of the thumb facing away from the implement;

wherein a first edge of the third support plate connects to the first support plate proximate the interior edge of the first support plate and a second edge of the third support plate connects to an interior surface of the belly plate facing the implement.

19. The machine of claim 17, wherein the second support plate intersects the second flat portion of the first support plate and the belly plate at acute angles.

20. The machine of claim 17, wherein an edge of the belly plate connects to the intermediate curved portion of the first support plate.

* * * * *